US009522403B2

(12) United States Patent
Hui et al.

(10) Patent No.: US 9,522,403 B2
(45) Date of Patent: Dec. 20, 2016

(54) REFILLABLE SPRAY BOTTLE

(71) Applicants: Yi Ming Hui, Guangdong (CN); Zhi Wang, Guangdong (CN)

(72) Inventors: Yi Ming Hui, Guangdong (CN); Zhi Wang, Guangdong (CN)

(73) Assignee: DONG-GUAN YIXIN MAGNETIC DISC CO., LTD, Guangdong (CN)

( * ) Notice: Subject to any disclaimer, the term of this patent is extended or adjusted under 35 U.S.C. 154(b) by 18 days.

(21) Appl. No.: 14/365,146

(22) PCT Filed: Dec. 12, 2012

(86) PCT No.: PCT/IB2012/057215

§ 371 (c)(1),
(2) Date: Jun. 13, 2014

(87) PCT Pub. No.: WO2013/088354

PCT Pub. Date: Jun. 20, 2013

(65) Prior Publication Data

US 2014/0312144 A1 Oct. 23, 2014

(30) Foreign Application Priority Data

Dec. 14, 2011 (CN) ..... 2011 2 0522423 U

(51) Int. Cl.
*B05B 11/00* (2006.01)

(52) U.S. Cl.
CPC ..... *B05B 11/0008* (2013.01); *B05B 11/0056* (2013.01); *B05B 11/0097* (2013.01);
(Continued)

(58) Field of Classification Search
CPC ..... B05B 11/0018; B05B 11/3026; B05B 11/3042;B05B 11/3047; B05B 11/3074; B05B 3/14; B65B 1/04; B67C 3/28; F04B 39/12; F04B 39/121; G01F 11/00
(Continued)

(56) References Cited

U.S. PATENT DOCUMENTS 3,357,603 A * 12/1967 Seiichi ..... B65D 83/42 222/402.16
3,432,080 A * 3/1969 Venus, Jr. ..... B65D 83/425 137/588
(Continued)

FOREIGN PATENT DOCUMENTS

CN 201329329 Y 10/2009
CN WO 2010072064 A1 * 7/2010 ..... B05B 11/0056
(Continued)

OTHER PUBLICATIONS

International Search Report of Corresponding International Application No. PCT/IB2012/057215.

*Primary Examiner* — Timothy L Maust
*Assistant Examiner* — Andrew Schmid
(74) *Attorney, Agent, or Firm* — William Dippert; Laurence Greenberg; Werner Stemer

(57) ABSTRACT

A refillable spray dispenser comprises a spray assembly, a hollow injection rod which is located with a liquid charging passage and a bottom portion within which the rod is positioned. The bottom portion includes bottom portion walls, a first seal, a second seal, and an exhaust hole in the bottom portion walls for release gas. The refillable spray dispenser is easy to exhaust gas, and is convenient to use.

19 Claims, 9 Drawing Sheets

(52) U.S. Cl.
CPC ..... *B05B 11/3025* (2013.01); *B05B 11/3026* (2013.01); *B05B 11/3074* (2013.01)

(58) Field of Classification Search
USPC ..... 141/2, 3, 18, 20, 39, 65, 113, 348, 349, 141/350; 222/159, 321.1, 321.2, 321.4, 222/321.7, 321.9, 385; 239/333; 29/888.02; 417/437
See application file for complete search history.

(56) References Cited

U.S. PATENT DOCUMENTS 3,559,701 A * 2/1971 Wittersheim ..... B65D 83/14 137/588
3,997,086 A * 12/1976 Shay ..... F04B 11/00 222/340
4,750,532 A * 6/1988 Grothoff ..... B05B 9/0838 141/113
4,804,109 A * 2/1989 Vanderjagt ..... B67D 7/0294 222/333
5,638,992 A * 6/1997 Lim ..... B65D 83/687 222/129
5,692,650 A * 12/1997 Wolter ..... B05B 11/0013 222/321.9
5,791,527 A * 8/1998 Giuffredi ..... B05B 11/0056 141/113
6,354,469 B1 * 3/2002 Pozzi ..... B05B 11/0018 222/189.09
6,415,959 B1 * 7/2002 Bougamont ..... B05B 11/0005 222/159
6,863,093 B2 * 3/2005 Garcia ..... A61M 11/06 141/18
7,222,646 B2 * 5/2007 Gupta ..... B65D 83/64 141/2
7,665,635 B2 * 2/2010 Ramet ..... B05B 11/0056 141/113
8,079,388 B2 * 12/2011 Turgeman ..... A45D 34/02 141/113
8,950,447 B2 2/2015 De Rosa et al.
8,978,938 B2 * 3/2015 Hui ..... B05B 11/0056 141/113
2001/0013379 A1 * 8/2001 Yquel ..... B65B 31/003 141/20
2002/0179635 A1 * 12/2002 Incardona ..... B67D 7/02 222/92
2003/0150876 A1 * 8/2003 Walters ..... B05B 11/3059 222/153.13
2005/0006412 A1 * 1/2005 Albisetti ..... B05B 11/0062 222/321.9
2009/0014481 A1 * 1/2009 Benetti ..... B05C 17/00516 222/563
2009/0261127 A1 * 10/2009 Pan ..... B05B 11/0037 222/256
2010/0025432 A9 * 2/2010 Yapaola ..... B05B 11/3098 222/175
2010/0089945 A1 * 4/2010 Law ..... B05B 11/3001 222/1
2010/0199606 A1 * 8/2010 Behar ..... B05B 11/0097 53/432
2011/0297275 A1 * 12/2011 Farrar ..... B05B 11/0043 141/113
2011/0309113 A1 * 12/2011 Hui ..... B05B 11/0056 222/402.16
2012/0090730 A1 * 4/2012 Dumont ..... A45D 34/02 141/2
2012/0255647 A1 * 10/2012 Dumont ..... B05B 11/0056 141/311 R
2012/0312842 A1 * 12/2012 Dumont ..... B05B 11/0032 222/321.9
2012/0312843 A1 * 12/2012 Dumont ..... B05B 11/0056 222/321.9
2013/0019991 A1 * 1/2013 Muller ..... B05B 11/3001 141/18
2013/0068796 A1 * 3/2013 Hui ..... G01F 11/028 222/256
2013/0078025 A1 * 3/2013 Turgeman ..... B41J 2/17513 401/258
2013/0126639 A1 * 5/2013 Tu ..... B05B 11/0056 239/302
2013/0320036 A1 * 12/2013 Muller ..... B05B 11/0016 222/51
2014/0027474 A1 * 1/2014 Dumont ..... B05B 11/3045 222/321.1
2014/0041753 A1 2/2014 Beranger et al.
2014/0060695 A1 * 3/2014 Dumont ..... B05B 11/0056 141/18
2014/0069551 A1 * 3/2014 Lasnier ..... A45D 34/00 141/18
2014/0086770 A1 * 3/2014 Octau ..... B29C 67/0044 417/437
2014/0102584 A1 * 4/2014 Lasnier ..... B05B 11/0056 141/18
2014/0137983 A1 * 5/2014 Tu ..... B05B 11/0056 141/113
2014/0312144 A1 * 10/2014 Hui ..... B05B 11/0056 239/302

FOREIGN PATENT DOCUMENTS

CN 102431714 A 5/2012
CN 202321216 U 7/2012
CN 202670439 U 1/2013
EP 2383204 A1 11/2011
GB 2095103 A 9/1982
WO 2011026969 A1 3/2011
WO 2012140366 A1 10/2012

* cited by examiner

REFILLABLE SPRAY BOTTLE

CROSS-REFERENCE TO RELATED APPLICATIONS

This patent application is a U.S. National Phase filing of PCT Patent Application No. PCT/IB2012/057215, filed Dec. 12, 2012, which in turn is based upon Chinese Patent Application No. 201120522423, filed Dec. 14, 2011, each of which is incorporated herein by reference in its entirety.

FIELD OF THE INVENTION

The invention relates to a spray bottle, in particular to a refillable spray bottle.

BACKGROUND OF THE INVENTION

At present, the available portable spray dispensers consist of a sprayer assembly and a bottle. Most of the spray dispensers are disposable and useless after running out of liquid. Some dispensers have accessories for refilling liquid, but the operations are complicated, and the dispensers are susceptible to leakage during refilling, which brings great inconvenience. Commercially available spray dispensers are made of plastics or glass materials, which easily pollute the environment after being discarded; for producers and customers, disposable products are uneconomical and cause huge waste of production materials. However, if the liquid is filled in a large bottle, it is not portable, which also brings inconvenience to the users and the producers.

SUMMARY

One objective is to provide a refillable spray dispenser which is convenient to use, easily exhausts gas, is compactly structured, and highly stable.

The embodiments are convenient to use, as the dispenser can be refilled with liquid repeatedly, the exhaust structure is simple, and the gas in the dispenser is easily exhausted when refilling with liquid so as to make the operation smooth.

Although methods and materials similar or equivalent to those described herein can be used in the practice or testing of the present invention, suitable methods and materials are described below. In case of conflict, the patent specification, including definitions, will control. In addition, the materials, methods, and examples are illustrative only and not intended to be limiting.

It is therefore provided in accordance with a preferred embodiment a refillable spray dispenser comprising:

a spray assembly;

a hollow injection rod comprising a rod fill hole and a rod injection hole;

a bottle having:

- a compartment in fluid communication with the spray assembly;
- a bottom portion within which the rod is positioned, the bottom portion comprising: bottom portion walls; a first seal and a second seal; a bottom opening, a portion injection hole and a portion exhaust hole in the bottom portion walls, and a passage extending from the portion exhaust hole to the bottom opening;

wherein the first seal seals the passage, preventing communication of fluid from the compartment to the bottom opening, and the second seal seals the rod injection hole, preventing communication of fluid from the rod fill hole to the compartment, when the injection rod is at a resting position, and wherein the first seal allows communication of fluid from the compartment, via the portion exhaust hole and the passage to the bottom opening, and the second seal allows communication of fluid from the rod fill hole, via the rod injection hole, to the compartment when the rod is in an extended position, wherein the injection rod comprising a groove or protuberance;

the first seal is being fixed to the bottom portion walls and seals the passage when the injection rod is in the resting position, and said groove or protuberance allows fluid to bypass said first seal when the injection rod is in the extended position.

It is therefore provided in accordance with another preferred embodiment refillable spray dispenser comprising:

a spray assembly;

a hollow injection rod provided with a rod fill hole and a rod injection hole;

a bottle having:

- a compartment in fluid communication with the spray assembly;
- a bottom portion within which the rod is positioned, the bottom portion comprises: bottom portion walls; a first seal; a bottom opening, a portion injection hole and a portion exhaust hole in the bottom portion walls, and a passage extending from the portion exhaust hole to the bottom opening;

a head is provided to the injection rod wherein the second seal is being positioned under the head;

wherein the first seal seals the passage, preventing communication of fluid from the compartment to the bottom opening, and the second seal seals the rod injection hole, preventing communication of fluid from the rod fill hole to the compartment, when the injection rod is at a resting position, and wherein the first seal allows communication of fluid from the compartment, via the portion exhaust hole and the passage, to the bottom opening, and the second seal allows communication of fluid from the rod fill hole, via the rod injection hole, to the compartment, when the rod is in an extended position.

Furthermore, in accordance with yet another preferred embodiment, the bottom portion further comprises a third seal situated between the portion exhaust hole and the second seal, and wherein the third seal tightly holds the rod such as to help prevent back-flow of fluid out of the bottom portion when the rod is in an extended position and the dispenser is being refilled.

Furthermore, in accordance with yet another preferred embodiment, the portion exhaust hole is positioned between the first seal and the second seal.

Furthermore, in accordance with yet another preferred embodiment, the portion exhaust hole and the second seal are positioned at a same level, and wherein the passage comprises a gap between said second seal and said bottom portion walls so as to allow fluid from the compartment to bypass the second seal and thereby flow from the exhaust hole to the bottom hole when the rod is in an extended position.

Furthermore, in accordance with yet another preferred embodiment, the rod further comprises a tooth proximal to the bottom opening, and the dispenser further comprising resilient elements held on the tooth, wherein the resilient elements configured to restore the rod from the extended position back to the resting position.

Furthermore, in accordance with yet another preferred embodiment, the dispenser is further comprising an endcap engaged with the bottom portion walls, the endcap is capable of supporting the rod.

Furthermore, in accordance with yet another preferred embodiment, the dispenser is further comprising a third seal held in the bottom portion under the injector rod, the third seal allowing to sealingly and fluidly couple a filling stem of a fluid bottle or a fluid-stem adaptor thereto.

Furthermore, in accordance with yet another preferred embodiment, the first seal is held in the bottom portion under the injector rod, and wherein the first seal allows to sealingly and fluidly couple a filling stem of a liquid bottle or a liquid-stem adaptor to the rod.

Furthermore, in accordance with yet another preferred embodiment, the first sealing ring has a circumference comprising grooves.

Furthermore, in accordance with yet another preferred embodiment, the dispenser further comprising a tube extending from the compartment adjacent the top opening to adjacent the portion exhaust hole, the tube thereby allowing exhaust of gas from the dispenser and essentially preventing exhaust of liquid from the dispenser.

Furthermore, in accordance with yet another preferred embodiment, the dispenser further comprising a gas-permeable gasket configured to be in fluid communication with the portion exhaust hole when the rod is in the extended position, and allows slow and controlled release of gas from the dispenser.

Furthermore, in accordance with yet another preferred embodiment, the bottle has rigid walls configured to allow forming a negative air pressure in the compartment, wherein the negative pressure thereby facilitates filling of the compartment with fluid.

Furthermore, in accordance with yet another preferred embodiment, there is essentially no take up of air in the compartment in compensation for the fluid dispensed.

Furthermore, in accordance with yet another preferred embodiment, the spray assembly comprises a vent hole that is arranged to compensate for dispensed liquid with air.

Furthermore, in accordance with yet another preferred embodiment, the spray assembly is mounted on top opening in a storage position in which the vent hole is closed off, wherein said spray assembly being movable with respect to the compartment in a dispensing position which said vent hole is free to enable air to be taken up.

Furthermore, in accordance with yet another preferred embodiment, the spray assembly comprises a dispensing pump actuatable by means of a push button, wherein the push button is mounted on a nozzle of the pump, wherein the push button comprises an upper region enabling exertion of finger pressure on said push button in order to be able to move said button axially, thereby actuating the pump; wherein the pump comprising:

- a body equipped with a plunger tube disposed in the bottle, wherein said tube being equipped with a valve for admitting the liquid into the pump;
- a piston mounted around said nozzle in order to delimit a metering chamber in the body;
- an extender within the body;
- a spring in abutment with a bottom of the extender,
- return of the push button over its suction travel being effected by a spring in said pump.

Furthermore, in accordance with yet another preferred embodiment, it is provided a kit comprising: the refillable spray dispenser of any one of claims 1 to 17, and at least one adaptor, wherein the adaptor is configured to allow sealingly and fluidly coupling a non-refillable dispenser with the injection rod of the refillable dispenser.

Furthermore, in accordance with yet another preferred embodiment, it is provided a kit comprising: the refillable dispenser of any one of claims 1 to 17 and a non-refillable dispenser, the refillable dispenser and the non-refillable dispenser sealingly and fluidly coupleable thereto.

Furthermore, in accordance with yet another preferred embodiment, the non-refillable dispenser is selected from a group of dispensers such as liquid dispenser or an aerosol.

Furthermore, in accordance with yet another preferred embodiment, the sealing of the rod injection hole is due to the injection rod fitting tightly within the second seal.

BRIEF DESCRIPTION OF THE DRAWINGS

For a better understanding of the invention and to show how it may be carried into effect, reference will now be made, purely by way of example, to the accompanying drawings.

With specific reference now to the drawing in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention; the description taken with the drawing making apparent to those skilled in the art how the several forms of the invention may be embodied in practice. In discussion of the various figures described herein below, like numbers refer to like parts. The drawings are generally not to scale.

In the accompanying drawings:

FIG. 1 is a sectional structure view of a prior art refill bottle structure having a spray assembly and a hollow injection rod comprising a rod fill hole and a rod injection hole.

FIG. 2 is an amplified sectional view of the area A as shown in FIG. 1.

FIG. 3 shows filling and exhausting of the prior art structure.

FIG. 4 is a sectional structural view of a first embodiment, with an exhaust hole on a wall of the bottom compartment; there is a fixed seal, and a rod with a groove for exhaust, wherein the fixed seal seals the groove when the rod is in resting position.

FIG. 5 is a view of the first embodiment being filled.

FIG. 6 is a sectional structural view of a second embodiment, in which the rod also has a groove, but the exhaust hole is differently situated, and again a fixed seal seals the groove when the rod is in a resting position.

FIG. 7 is a view of the second embodiment being filled.

FIG. 8 is a sectional structural view of a third embodiment, in which there is a protuberance on the rod rather than a groove, and there is a fixed seal that sealingly abuts the protuberance when the rod is in a resting position.

FIG. 9 is a view of the third embodiment 4 being filled.

FIG. 10 illustrates another embodiment similar to the embodiment shown in FIGS. 6 and 7. The dispenser has a shield to protect the first seal from the resilient elements.

FIG. 11 shows in enlarged perspective view the injection rod, an exhaust gasket and third seal of the dispenser depicted in FIG. 10, wherein the exhaust gasket and the third seal both have a corrugated structure that allows gas to pass between them and bottom walls to outside.

Figure 12:
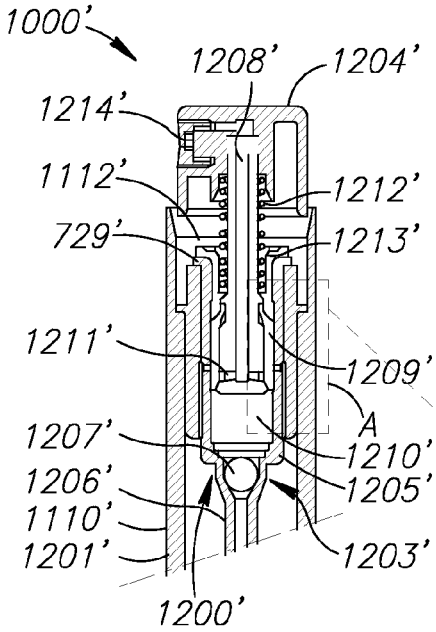

FIG. 12 shows the top part of an embodiment in which a pump is mounted so as to be able to slide with respect to the body to a lower position in which a vent hole is free to enable air to be taken in.

Figure 13:
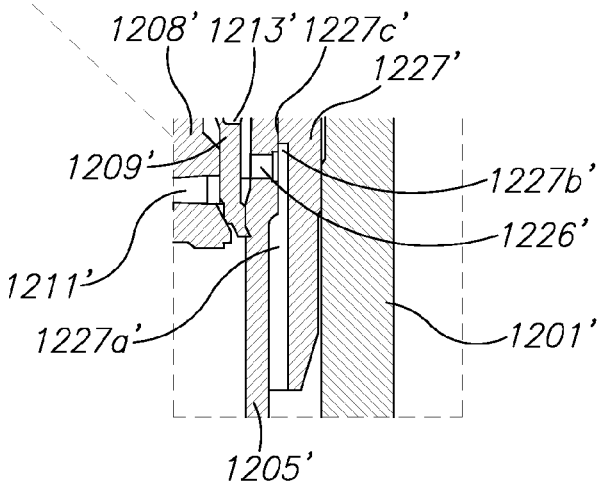

FIG. 13 is an exploded view of a portion of the part A shown in FIG. 12.

Figure 14:
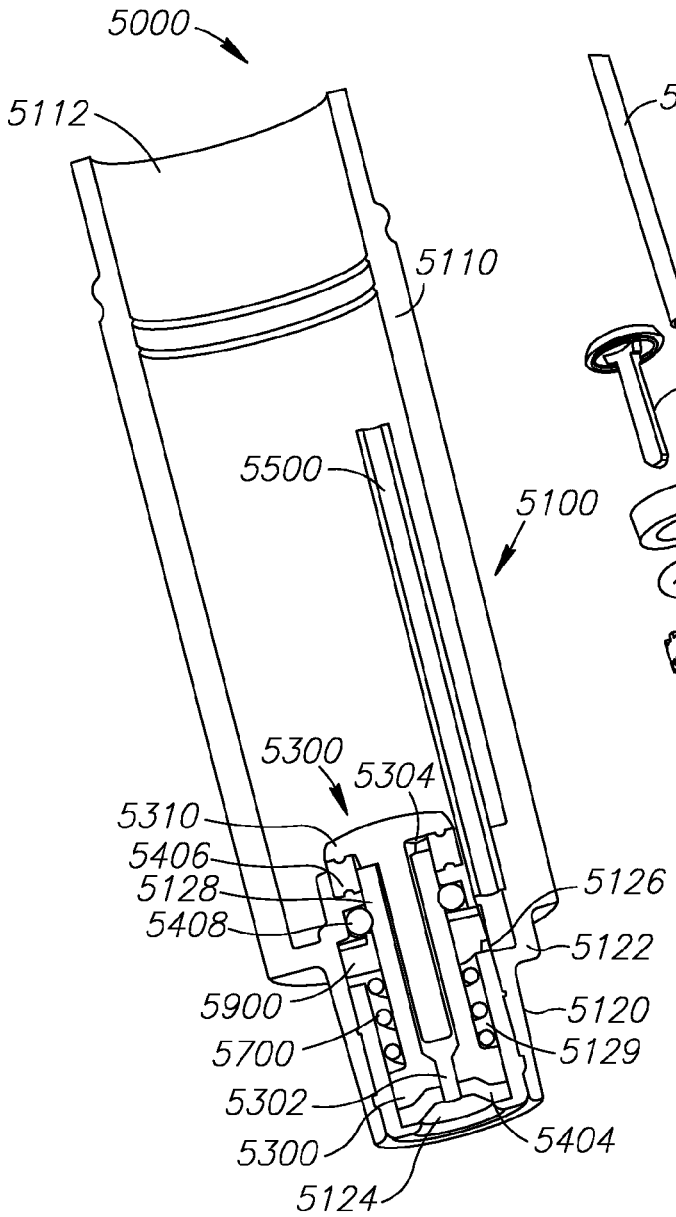

FIG. 14 depicts yet another embodiment, having a soft seal and an injection rod with a head, and the head blocks the seal when the rod is in resting position.

Figure 15:
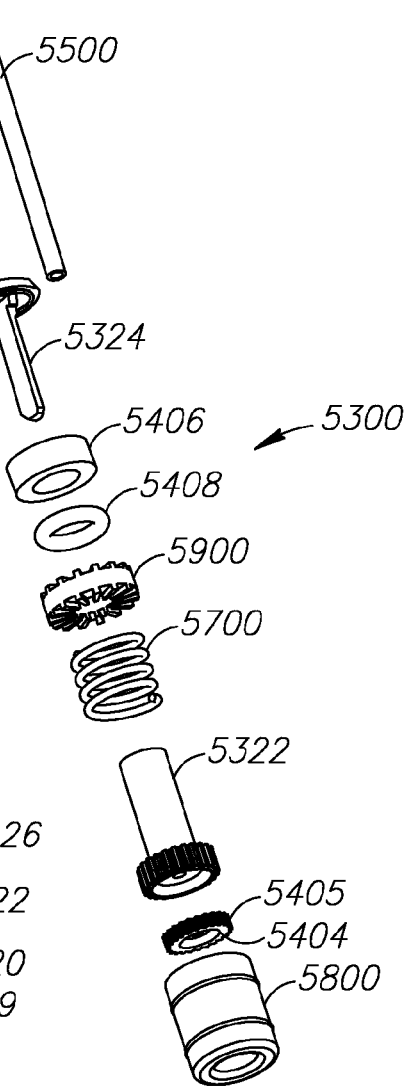

FIG. 15 shows an exploded view of parts of the filling and exhaust mechanism of the embodiment depicted in FIG. 14.

Figure 16:
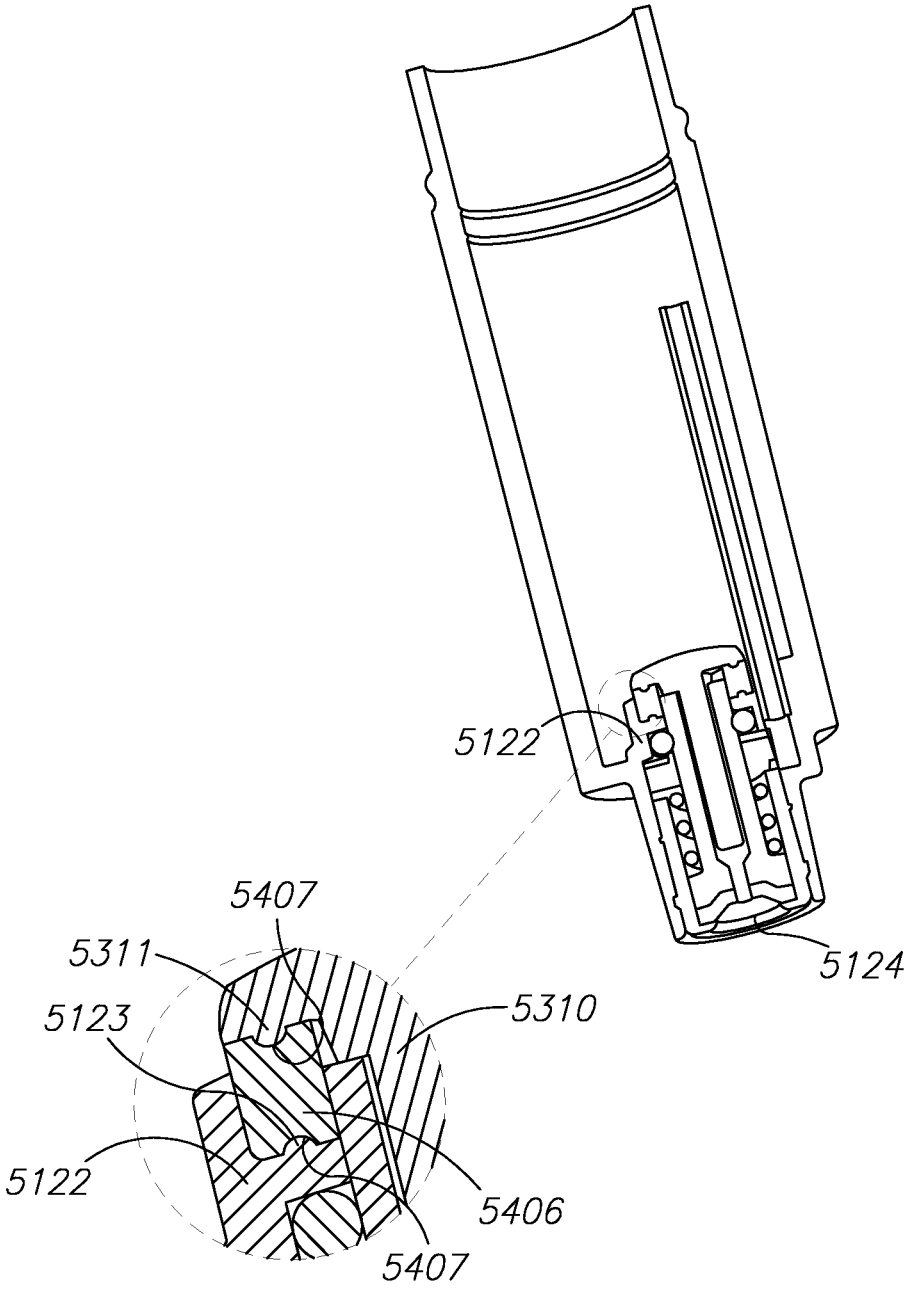

FIG. 16 is an enlarged view of the soft seal and a surrounding part thereof of embodiment shown in FIG. 14.

DETAILED DESCRIPTION OF THE INVENTION

Before explaining at least one embodiment in detail, it is to be understood that the invention is not necessarily limited in its application to the details set forth in the following description or exemplified by the Examples. The invention is capable of other embodiments or of being practiced or carried out in various ways.

It is appreciated that certain features, which are, for clarity, described in the context of separate embodiments, may also be provided in combination in a single embodiment. Conversely, various features, which are, for brevity, described in the context of a single embodiment, may also be provided separately or in any suitable sub-combination or as suitable in any other described embodiment. Certain features described in the context of various embodiments are not to be considered essential features of those embodiments, unless the embodiment is inoperative without those elements.

In discussion of the various figures described herein below, like numbers refer to like parts. The drawings are generally not to scale. For clarity, non-essential elements were omitted from some of the drawings.

According to one aspect, various improved spray dispenser embodiments are provided with a bottle and a refill mechanism and a modified exhaust assembly, wherein the refill mechanism and the exhaust assembly share parts and cooperate, such that when the bottle is filled with liquid, gas automatically escapes the bottle, and when the bottle is not filled with liquid, gas cannot escape. In particular, the embodiments have modified rods through which the dispensers are filled, and which define, together with other parts of the dispenser, a passage via which fluid such as excess gas may be exhausted and may be blocked to prevent undesired leak of fluid.

Figure 1:
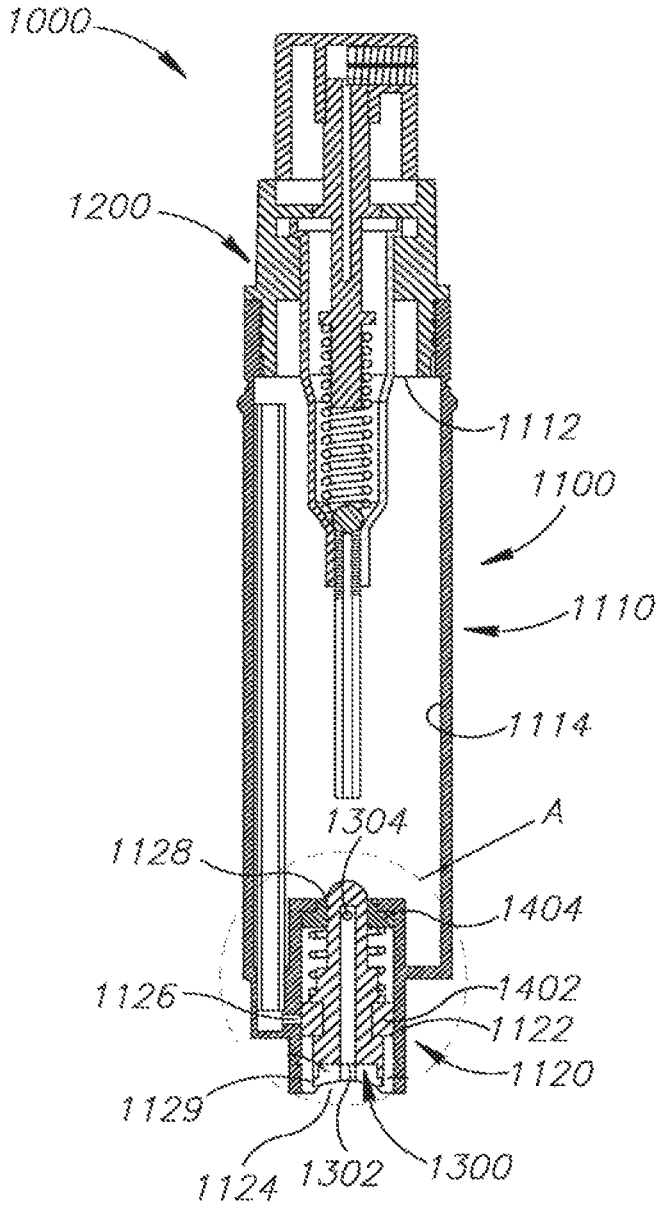
PRIOR ART FIG.1

A prior art refillable spray dispenser 100 is shown in FIG. 1, and described in WO 2010/072064, as an example. The dispenser comprises:

a spray assembly 1200;

a hollow injection rod 1300 comprising a rod fill hole 1302 and a injection rod hole 1304;

a bottle 1100 having:

a compartment 1110 in fluid communication with the spray assembly 1200;

a bottom portion 1120 holding the rod 1300 and comprising: bottom portion walls 1122; a first seal 1402 and a second seal 1404; a bottom hole 1124, a portion exhaust hole 1126 and a portion injection hole 1128 in the bottom portion walls 1122, and a passage 1129 extending from the portion exhaust hole 1126 to the bottom opening 1124;

wherein the first seal 1402 seals the passage 1129, preventing communication of fluid from the compartment 1110 with the bottom opening 1124, and the second seal 1404 seals the injection rod hole 1304, preventing communication of fluid between the rod fill hole 1302 and the compartment 1110, when the injection rod 1300 is at a resting position, and wherein the first seal 1402 allows communication of fluid from the compartment 1110, via the portion exhaust hole 1126 and the passage 1129, to the bottom opening 1124, and the second seal 1404 allows communication of fluid from the rod fill hole 1302, via injection rod hole 1304, to the compartment 1110, when the rod 1300 is in an extended position. Seal are for example O-ring, gasket, rubber stopper with a hole etc.

Figure 2:
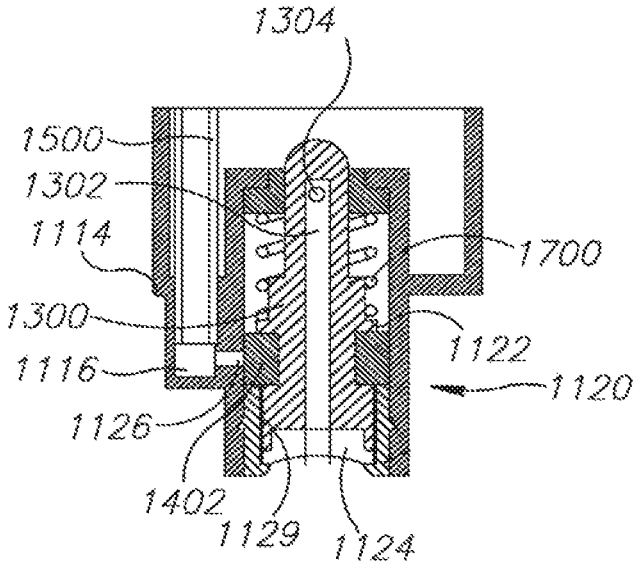
PRIOR ART FIG.2

FIG. 2 shows for clarity an enlarged view of area A, i.e. the bottom portion of the dispenser 1000. In both FIG. 1 and FIG. 2, the injection rod 1300 is at a resting position.

In particular to the dispenser 1000 shown in FIGS. 1 and 2, the first seal 1402 is movably coupled to the injection rod 1300 and blocks the exhaust hole 1126 when the injection rod 1300 is in the resting position. The passage 1129 extends from below the first seal 1402 to the bottom opening 1124.

Figure 3:
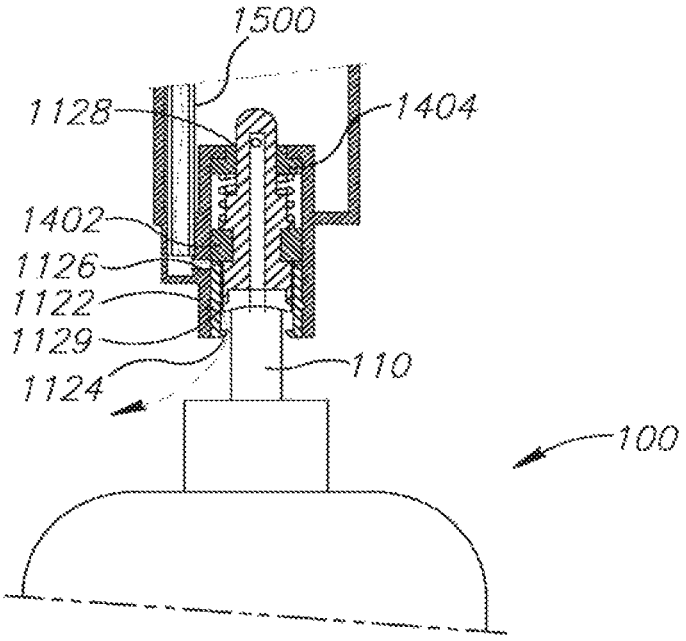
PRIOR ART FIG.3

Reference is made to FIG. 3 showing the injection rod 1300 in an extended position. As mentioned herein before, the first seal 1402 is movably coupled to rod 1300. A stem 110 of a liquid or liquid-gas mixture reservoir 100 is pushed against the rod 1300 so that the rod 1300 moves up toward the injection opening 1128. The first seal 1402 moves along with the injection rod 1300 and thus no longer blocks exhaust hole 1126. As a result of the push of injection rod 1300, injection rod hole 1304 also becomes unblocked by second seal 1404. Therefore, gas may both enter the bottle 1100 from the reservoir 100, thus helping to introduce liquid into the compartment 1110, and be exhausted, when the rod 1300 is pushed by the stem 110.

Note that the bottom portion 1120 actually has the exhaust hole 1126 essentially horizontally extending throughout the bottom portion walls 1122 of the bottom portion 1120. Exhaust hole 1126 is being adjacent to the bottom of an exhaust tube 1500 that is wedged inbetween the bottom portion walls 1122 and walls 1114 of the compartment 1110 such as to create a sealed space 1116 between the tube 1500 and the exhaust hole 1126. The tube 1500 allows exhaust of gas from the dispenser 1000 and essentially prevents exhaust of liquid from the dispenser 1000 through the bottom portion.

Pressurized gas present in the compartment 1110 accumulates at the top of the compartment 1110 (assuming the dispenser is held upright as in the figures), enters the tube 1500 from its top, goes out from the bottom of the tube 1500, and subsequently travels throughout the exhaust hole 1126. From there, it travels through the bottom portion 1120 and out of the dispenser via bottom hole 1124, as shown in the dashed line.

Figure 4:
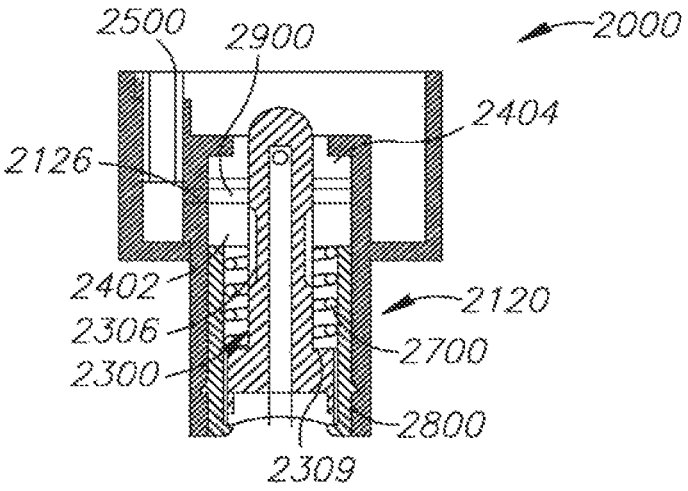
Figure 5:
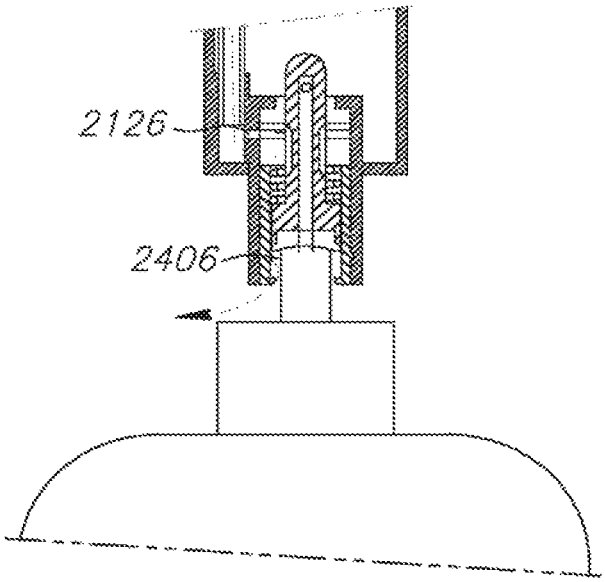

A modified bottom portion 2000 of a dispenser is depicted in FIGS. 4 and 5.

In the embodiment 2000, the injection rod 2300 further comprises a groove 2306. In contrast to the prior art dispenser 1000 described above, the first seal 2402 is fixed to the compartment 2120 and seals between the exhaust opening 2126 and the groove 2306 when the injection rod 2300 is in the resting position, as it is in FIG. 4.

The groove 2306 allows gas to bypass said first seal 2402 when the injection rod 2300 is in the extended position, as shown in FIG. 5.

In particular to the embodiment shown in FIGS. 4 and 5, the exhaust opening 2126 is between said first seal 2402 and said second seal 2404.

Figure 6:
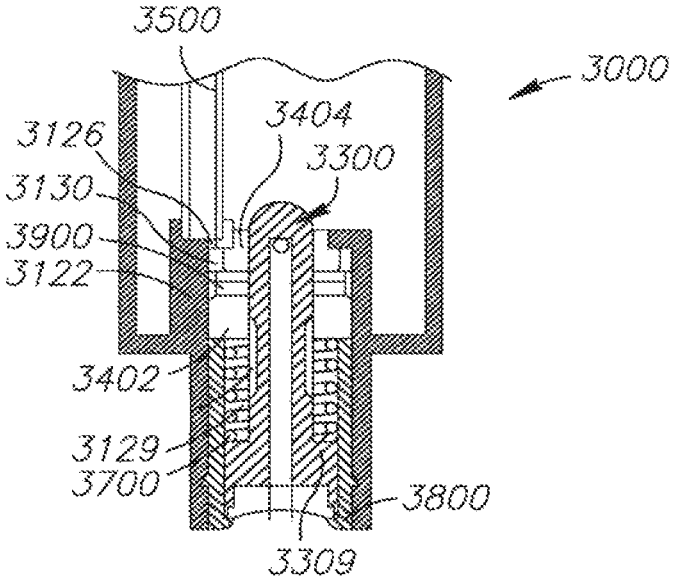
Figure 7:
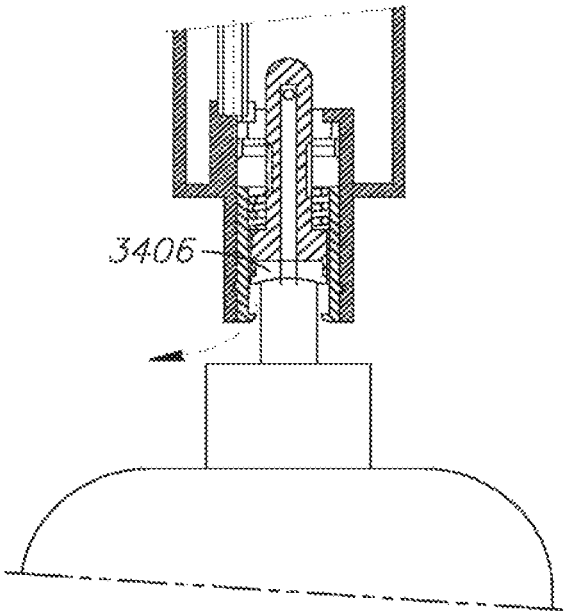

Another embodiment 3000 is shown in FIGS. 6 and 7. The embodiment is similar to embodiment 2000 shown in FIGS. 4 and 5; however, in contrast, the compartment exhaust opening 3126 is not between the first seal 3402 and second seal 3404, but rather is at about the same level as the second seal 3404. The passage 3129 comprises a gap between said second seal 3404 and said bottom portion walls 3122, as shown in FIGS. 6 and 7. Passage 3129 allows gas to bypass said first seal 3404 as shown in the path described in FIG. 7 by a dash line. The tube 3500 is preferably embedded in the bottom portion walls 3122 as shown. Whereas the previously described dispensers 1000 and 2000 have rather complex structures to accommodate the tubes 1500 and 2500, and lead them to the exhaust holes 1126 and 2126, respectively, the structure of the presently described embodiment 3000 is somewhat simpler, although it requires four holes instead of three and may be less rugged.

Figure 8:
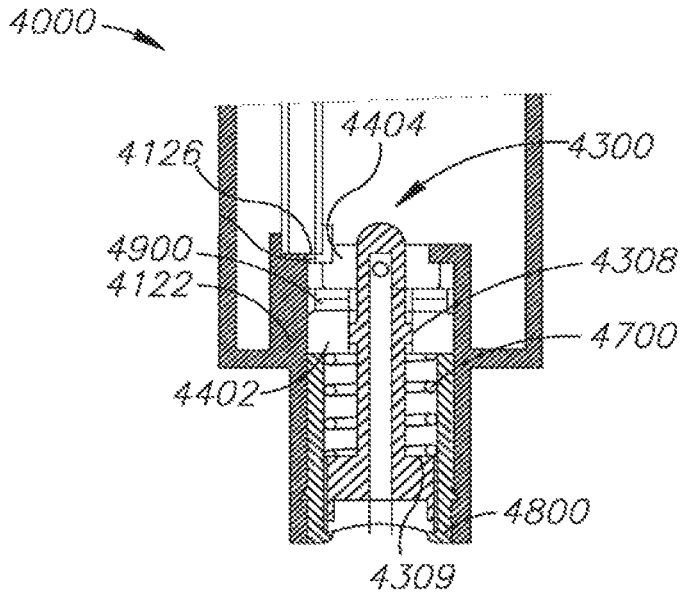
Figure 9:
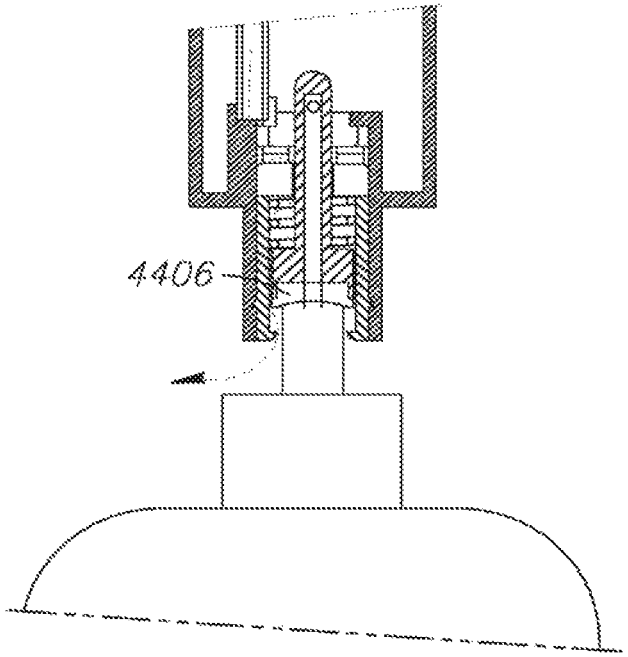

FIGS. 8 and 9 illustrate yet another embodiment 4000. Here, too, there is an exhaust hole 4126 levels with the second seal 4404. The injection rod 4300 comprise a protuberance 4308 and the first seal 4402 that is fixed to the bottom portion walls 4122 and abuts the protuberance 4308 when the injection rod 4300 is in the resting position (FIG. 8). This structure prevents passage of gas between the first seal 4402 and the injection rod 4300, and does not abut the protuberance 4308 when the injection rod 4300 is in the extended position as shown in FIG. 9, such that gas can bypass the first seal 4402.

As in the previously described dispensers, in some embodiments with protuberances on the rod, the exhaust hole is between the first seal and the second seal.

Referring now to all of FIGS. 4 to 8, the refillable spray dispensers all further comprise resilient elements (springs in the figures) 2700, 3700 and 4700, respectively, configured to restore the rods 2300, 3300, 4300 respectively, from the extended position back to the resting position. However, it is stressed that some embodiments may not be equipped with resilient elements, and the rod may return to its resting position by the effect of gravity or another force, including manual force, applied upon it.

It is further notable that the resilient elements 1700 of the prior art dispenser 1000 shown in FIGS. 1-3 is held between the first seal 1402 and the second seal 1404 (on top of the first seal 1402).

In contrast, in the embodiments 2000, 3000, and 4000, the resilient elements 2700, 3700 and 4700, respectively, are held between the first seal 2402, 3402, and 4402 respectively, and a tooth 2309, 3309, 4309 on the injection rod.

The refillable spray dispensers may further comprise a third seal, e.g. a sealing ring 2406, 3406, or 4406 held in the bottom portion under the injector rod, that allows to sealingly and fluidly couple a filling stem 110 or an adaptor thereto. However, note that the third seal does not seal off the opposite walls of the bottom portion to passage of gas. The first, second and third seal are for example O-rings.

Another feature in all of the embodiments is an endcap 2800, 3800, and 4800, respectively. The endcaps 2800, 3800, and 4800 are engaged in the bottom portions 2120, 3120 and 4120, and are capable of supporting a respective assembly of rods, seals and resilient elements. Typically, in such embodiments, a second seal is first selected to fit the rod and the injection opening of the embodiment 2000, 3000 or 4000 or other similar embodiments, so as to seal the bottom portion from the compartment when the rod is in a resting position, and to leave a gap when required (embodiments 3000 and 4000). The second seal is positioned as shown, relative to the compartment injection opening. Then, an assembly of a rod, resilient elements and seals are installed so that the top of the rod is snugly engaged in the hole of the second seal with the injection hole blocked by the second seal and so that the first seal is properly positioned as described above in the resting position. The endcap can then be pushed into the bottom portion through the bottom opening and be snapped into place as is apparent in the figures.

The bottom portion and the compartment may be one unit, or may be assembled from two separately manufactured units.

Yet another feature in the depicted embodiments 2000, 3000, and 4000 is a gas-permeable exhaust gasket 2900, 3900, and 4900, respectively. The exhaust gaskets 2900, 3900 and 4900 may have a pinhole passing therethrough to allow slow and controlled release of gas: escape of gas without such gasket might be excessively fast whereas the controlled release may help prevent escape of too much gas, inadvertent loss of liquid etc. However, some embodiments may lack this feature. Note that the structure of the gaskets and the path/size of the pinhole may differ between the various embodiments. For example, in the embodiments 3000 and 4000, the pinhole may travel vertically in the top part of the gasket (open to the gap 3128 and 4128, respectively) and then horizontally continue to the inner perimeter of the gasket, whereas in the embodiment 2000, the gasket may have the pinhole horizontally passing therethrough, opening on the outer perimeter to the exhaust opening 2134.

Figure 11:
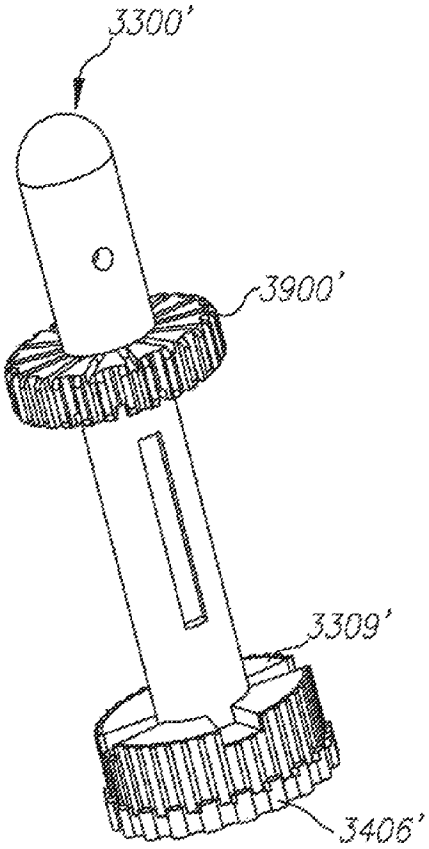
Figure 10:
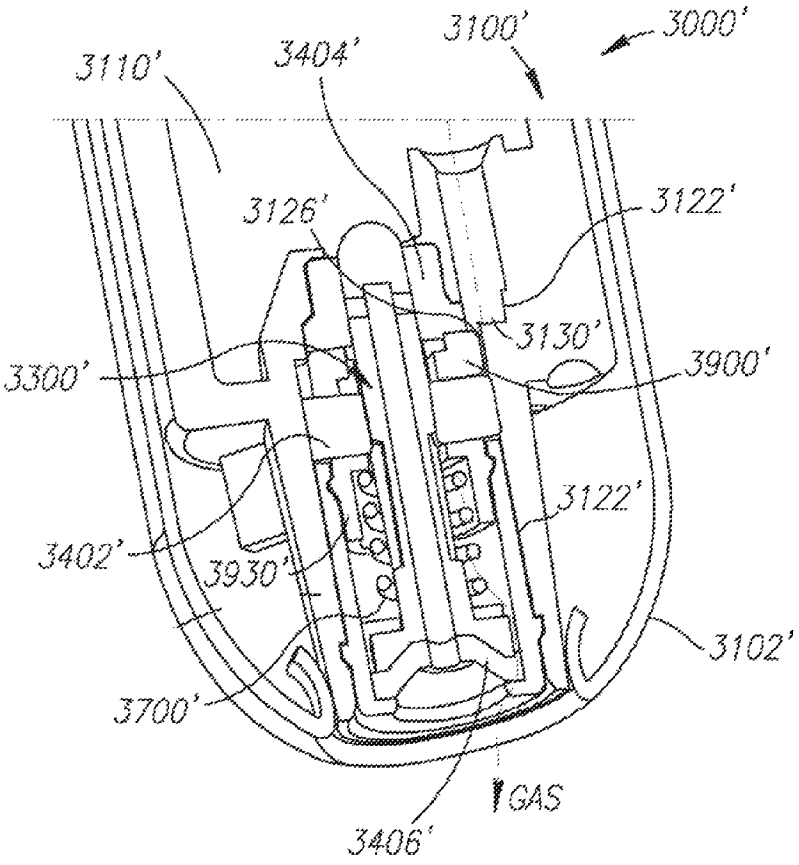

FIGS. 10 and 11 show another embodiment 3000' similar to the embodiment 3000 shown in FIGS. 6 and 7. Again, there is a gap 3130' in this embodiment part of exhaust hole 3126' between the second seal 3404' and a bottom portion wall 3122', that allows gas to bypass the second seal 3404', as shown in the path described in FIG. 10. The injection rod 3300' is shown in FIG. 11 assembled with an exhaust gasket 3900' and a third seal 3406'. The exhaust gasket 3900' and the third seal 3406', both have a corrugated structure that allows gas to pass between them and the bottom walls 3124' to outside. The tooth 3309' also has a corrugated structure for the same purpose.

Note that the bottom portion also has a shield 3930', against which the resilient elements 3700' is pressed so as to protect the first seal 3402' from the resilient elements 3700'. The dispenser includes a shell 3102' that contains at least the bottom part of the bottle 3100'. The bottle 3100' may be transparent and the shell may be opaque, besides a window (not shown) facing the compartment 3110', to show the level of the liquid inside the compartment 3110'.

Commercially available dispensers can perhaps be refilled by removing their dispensing mechanism, but for all practical purposes such refilling is time consuming and difficult, and thus they are essentially non-refillable. Furthermore, their size, typically 250 mL or larger, is substantially larger than the refillable dispensers that are typically less than 100 mL size, so that there is little motivation to refill the larger dispensers.

Thus, according to another aspect, a kit comprising any refillable dispenser of the types described above and at least one adaptor is provided. The adaptors, each configured to allow sealingly and fluidly connecting a non-refillable dispenser for fluids etc. with the filling mechanism of the refillable dispenser. Each adaptor is suitable for a particular structure of dispensing mechanism of the non-refillable dispenser. Thus, a set of adaptors may serve to couple the first refillable dispenser with various commercially available non-refillable dispensers.

Many commercially available dispensers have a dispensing head that may be removed in order to expose the dispensing mechanism of the non-refillable dispenser. The exposed mechanism may then be easily coupleable to the refill mechanism. Such removal will typically expose a structure such as a stem 110 of the dispensing mechanism 100 (see FIG. 3).

The adaptor may be a tube having ends with the same or different sizes. Typically, one end tightly fits into the refill assembly of the refillable dispenser, and the other end tightly fits onto a stem of the dispensing mechanism of the non-refillable dispenser to make a sealed connection for transfer of the fluid from the non-refillable dispenser to the refillable one. Alternatively, the adaptor may be a dispensing mechanism itself that replaces the original dispensing mechanism of the non-refillable dispenser.

According to another aspect, a kit comprising the refillable dispenser and a non-refillable dispenser is provided. The uniqueness of the non-refillable dispenser in this embodiment is that the refillable dispenser and the non-refillable dispenser are configured to allow sealingly connecting the non-refillable dispenser with the refill mechanism, preferably without need for an adaptor. Such non-refillable dispenser may be a commercially available dispenser, the refillable dispenser being specially fitted in the dimensions of the refill mechanism to the dispensing mechanism of the non-refillable dispenser, but perhaps more typically the non-refillable dispenser is also specially designed to easily and tightly fit with the refillable dispenser.

Typically, the non-refillable dispenser will be economy-sized and too large to carry in a wallet, pocket etc. The non-refillable dispenser further minimizes waste of material.

It is notable that while the non-refillable dispenser is ideal to use at home, the refillable dispenser is ideal for use on airplanes, since at present only very small containers of compositions are allowed to be airborne in a flight cabin.

Some embodiments may be manipulated to have a sub-pressure in the bottle, at least when the bottle is essentially empty of material and ready to receive more material.

For example, see FIGS. 12-13 illustrating the top part of an embodiment in which a pump is mounted so as to be able to slide with respect to the body to a lower position in which a vent hole is free to enable air to be taken in.

The compartment 1110' has sufficient rigidity so that the volume of the dispenser 1000' remains substantially constant. The dispenser 1000' may have for example a capacity of between 1 and 20 ml (whereby the dispenser is conveniently pocket-sized).

The dispenser 1000' may be in a single piece, for example produced by injection blowing or extrusion blowing, or in several parts injected and then assembled, for example by ultrasonic welding, made from rigid plastics material, metal, for example aluminum or glass.

The dispenser 1000', and similarly other embodiments, also comprises a spray assembly 1200' that is mounted sealingly on the compartment 1110', in particular in the top opening 1112' of the compartment. The dispensing device comprises a dispensing pump 1203' actuated manually by means of a push button 1204'.

The pump 1203' comprises a body 1205' equipped with means of supplying the material. In the figures, the supply means comprise a plunger tube 1206' disposed in the compartment 1110', said tube being equipped with a valve 1207' for admitting the product (e.g. liquid, aerosol) into the pump 1203'. The push button 1204' is mounted on the nozzle 1208' of the pump 1203', which comprises a piston 1209' mounted around said nozzle in order to delimit a metering chamber 1210'. The piston 1209' enables the supply orifices 1211' to be in fluid communication with the metering chamber 1210' when the push button 1204' is pushed downwardly. Upon release of the push button, the piston closes supply orifices so that under-pressure is formed in the metering chamber.

The push button 1204' comprises an upper region enabling the user to exert finger pressure on said push button in order to be able to move it axially over its travel for actuation of the pump 1203', the return of the push button 1204' over its suction travel being conventionally affected by a spring 1212'. In the embodiment shown, the interior of the body 1205' of the pump 1203' is equipped with an extender 1213' on which the bottom end of the spring 1212' is in abutment.

The push button 1204' is equipped with a head 1214' that is arranged to distribute the product radially. However, the invention is not limited to a particular method of dispensing the product.

The dispensing method makes provision, prior to the initial filling of the compartment 1110' with product, for putting said empty product reservoir in communication with an air suction device and activating said device in order to create a negative pressure inside said reservoir.

According to one embodiment, the air suction device comprises a vacuum bell in which the body of the pump 1205' is disposed, the sealed mounting of the pump 1203' on the compartment 1110' being achieved after activation of said bell. Thus the negative pressure is formed in the top compartment and then the pump 1203' is mounted sealingly so as to maintain said negative pressure.

According to another embodiment, the air suction device, for example a vacuum pump, is put in communication with the pump 1203' after sealed mounting thereof on the compartment 1110', the suction of the air from the dispenser 1000' being effected through the pump. In a variant, the suction of air could be affected through the refill assembly (rod, seal, resilient elements etc. in the bottom portion, not shown) by making provision to put it into communication with the air suction device after sealed mounting of the pump 1203' on the body 1205'.

The dispensing method makes provision for subsequently affecting the initial filling of the compartment 1110' by putting a product source in sealed communication with said compartment 1110' by means of the refill assembly so that the negative pressure causes the filling of said reservoir by suction of the product contained in said source. Next, the customer can actuate the pump 1203' in order to dispense the packaged product.

A single press on the rod may cause the opening of a pump of a non-refillable dispenser, so as to form a transfer path of product between the source and the compartment 1110'. Compensation for the negative pressure then allows filling. Next, when the compartment 1110' is filled, the suction negative pressure becomes zero and the refill assembly is then closed and the product contained in the compartment 1110' can be dispensed subsequently by means of the pump 1203'.

The dispenser 1000' that is supplied to the distributors may therefore be empty of product and have a negative air pressure, the negative pressure making it possible to subsequently affect the initial filling, in particular at the time of handing the dispenser 1000' to the customer according to the product that they wish to purchase and/or test. The method therefore allows a particularly versatile initial filling, which in particular allows simplified management of the dispenser 1000' by the distributors, in particular sample test dispenser 1000'.

The versatility of the dispensing method can also be improved by providing the association of a label on the dispenser 1000' at the time of initial filling of the compartment 1110' with product, in particular according to the product. The label can have a detachable part comprising a sales offer particular to the distributor in order to encourage the customer to return and purchase the sampled product.

In relation to FIGS. 12 to 13, the pump and the spray assembly 1200' are of the airless type without the take up of air in the compartment in compensation for the volume of product dispensed. To do this, the body 1205' of the pump 1203' in assembly 1200' has no vent hole as well as the dispenser itself, that doesn't need a vent for pressurized air such as vents shown in the previous figures.

However, since pumps with a vent hole are the most usual, it may be advantageous to create a negative pressure in the upper compartment even with this type of pump. To do this, as shown in spray assembly 1200' in FIG. 13, body 1205' is provided with a vent hole 1226' that is closed off sealingly by mounting thereof in the rigid body 1201' (FIG. 13). In particular, the seal between the body 1205' and rigid body 1201' is then made at least below the vent hole 1226' so as to prevent the passage of air from the pump 1203' into the compartment 1110' by means of said hole. In FIG. 13, the seal is also achieved above the vent hole 1226', which does not impair the functioning without take up of air and is a little simpler to achieve.

The product sample without take up of air in the compartment 1110' makes it possible to create in said compartment 1110' a negative pressure that increases along with dispensing. In particular, in order to ensure total emptying of the compartment 1110', the ceiling of air above the product during initial filling must be such that the negative pressure reached at the end of emptying is at a maximum equal to the negative pressure achievable by the pump 1203'.

In this embodiment, the sub-pressure may allow subsequent filling of the compartment 1110' merely by bringing the product source (non-refillable dispenser) into liquid communication with said compartment 1110'.

It should be noted that other airless pumps can be used for this dispenser so as to eliminate the need to provide an air vent to the dispenser in order to overcome the high pressure formed in the dispenser due to the filling of liquid to within the compartment. The structure shown in FIGS. 12 and 13 by no means limit the scope of the present invention.

the maintenance of the negative pressure over time, the refill assembly may be reversibly covered with a sealing cap (not shown). The cap may be welded in a recess formed on the free end of a trim (not shown) so that the cap completely covers the refill assembly. The cap is having a free edge enabling it to be withdrawn with a view to the initial filling.

The sub-pressure may facilitate refilling of the dispenser.

FIG. 14 depicts yet another embodiment 5000, having a second seal 5406 on top of the bottom portion 5120, and an injection rod 5300 with a head 5310. The head 5310 is pressed against the second seal 5406 when the rod is in resting position.

FIG. 15 shows an exploded view of parts of the filling and exhaust mechanism of embodiment 5000 depicted in FIG. 14.

The refillable spray dispenser 5000 comprises:

- a spray assembly (not shown);
- a hollow injection rod 5300 comprising a head 5310, a rod fill hole 5302 and a rod injection hole 5304;
- a bottle 5100 having:
  - a compartment 5110 in fluid communication with the spray assembly;
  - a bottom portion 5120 holding the rod 5300 and comprising: bottom portion walls 5122; a first seal 5404, a third seal 5408; a bottom opening 5124, a portion injection hole 5128 and a portion exhaust hole 5126 in the bottom portion walls 5122, and a passage 5129 extending from the portion exhaust hole 5126 to the bottom opening 5124;
  - a second seal 5406 positioned on top of the bottom portion 5120;
  - the first seal 5404 positioned under the rod 5300 and the third seal 5408 positioned between the second seal 5406 and the first seal 5404, and between the walls 5122 and the rod 5300;
- wherein the first seal 5404 seals the passage 5129, preventing communication of fluid from the compartment 5110 to the bottom opening 5124, the second seal 5406 seals the rod injection hole 5304, preventing communication of fluid from the rod fill hole to the compartment 5110 when the injection rod 5300 is at a resting position (as in FIG. 14), and
- wherein the first seal 5404 allows communication of fluid from the compartment 5110, via the portion exhaust hole 5126 and the passage 5129, to the bottom opening 5124, the second seal 5406 allows communication of fluid from the rod fill hole 5302, via rod injection hole 5304, to the compartment 5110, and the third seal 5408 prevents communication of fluid from the compartment 5110 via the rod injection hole 5304 and the passage 5129 to the bottom opening 5124, when the rod 5300 is in an extended position (not shown).

During the extension of the rod, a product such as a liquid or aerosol may be introduced into the bottle and simultaneously, introduction of gas such as air may be exhausted from the bottle. When the rod is in the resting position, the bottle is sealed.

Comparing the presently described embodiment 5000 to the formerly described embodiments, the first seal 5404 and the second seal 5406 have a similar function, although they are at different positions in the dispenser 5000. However, note that the first seal 5404 has a dual role: similar to the third seal in the formerly described embodiments, the first seal 5404 also serves to allow leak-less coupling of a stem 110 of a reservoir 100 (Not shown in FIGS. 14 and 15) to the rod 5300. Whereas in the formerly described embodiments, the second seal had the role of preventing fluid from escaping the compartment via the portion injection hole at the bottom portion, both when the rod 5300 is in the extended position and when the rod is in the resting position. The second seal 5406 prevents fluid from escaping the compartment 5120 via the portion injection hole 5128 of the bottom portion 5110 when the rod 5300 is in the resting position, but it is the third seal 5408 that prevents the same when the rod 5300 is in an extended position. However, the position of third seal 5408 above the exhaust opening 5126 does allow fluid to go from the compartment 5120, via the exhaust opening 5126, to outside the dispenser.

The first seal 5404 has the same position as the third seal in those embodiments, i.e. under the rod. The first seal is made of a fairly hard silicon rubber that can sustain forces from repeatedly pushing a stem 110 against it. As shown in FIG. 15, the first seal 5404 has small grooves 5405 on its circumference, such that when the first seal 5404 is pressed by the stem 110, the grooves 5405 allow fluid to pass between the first seal 5404 and the walls 5122. When the first seal 5404 is not pressed by a stem 110, the bottom of the first seal 5404 essentially prevents passage between the grooves 5405 and the bottom opening 5124 to outside the dispenser 5000.

Whereas in the formerly described embodiments, the sealing of the rod's injection hole is due to part of the injection rod (at the level of the injection hole) fitting tightly within the second seal, the sealing of the rod injection hole 5304 works by a different principle: the rod 5300 further comprises a head 5310. When the rod is in the resting position, as in FIG. 14, the spring 5700 urges the head 5310 (as part of the rod 5300) towards the first seal 5404 sufficiently to essentially prevent transfer of fluid from the compartment 5110 via the rod 5300 to the bottom opening 5124. The first seal 5404 is coupled to the rod 5300. A stem of a reservoir is typically pushed against the third seal 5406 for filling the bottle 5100, as in previously described embodiments. The second seal 5406 is preferably soft and pliable relative to the first seal, to allow the second seal to yield to the head 5310 and thereby provide a tight fit thereof.

The third seal 5408 tightly holds the rod 5300. The third seal 5408 is between the first seal 5404 and the second seal 5406 and helps prevent back-flow of fluid out of the bottom compartment 5120 when the rod 5300 is in an extended position and the bottle 5100 is being refilled. However, other embodiments may lack a third seal, without any substantial change in functionality of the dispenser. The third seal 5408 preferably has hardness in between that of the first seal 5404 and that of the second seal 5406.

FIG. 15 shows the filling mechanism and the exhaust mechanism in an exploded view. The rod, as shown, is made of a bottom part 5322 and a top part 5324, coupled to each other, so that pushing the bottom part 5322 to a certain extent, causes equal extension of the top part 5324. However, in other embodiments, the rod may have a head in a shape such as shown, yet the rod may be one piece.

Further shown in FIG. 15 are the exhaust tube 5500 and the endcap 5800.

Note that tube 5500 is somewhat further away from the compartment opening 5112, than is the tube 1500 in the formerly described dispenser 1000, yet the top of the tube 5500 is still closer to the top opening 5112 than to the injection opening 5128, i.e. the tube 5500 is adjacent to the top opening 5112 for all practical purposes of allowing in gaseous substances and preventing access of liquid substances into the bottom portion 5120.

Referring to an enlarged view of part of the bottom portion 5120, shown in FIG. 16, the walls 5122 comprise a rim or ridge 5123 and the head 5310 comprises a rim or ridge 5311. The second seal 5406 comprises a groove 5407 and preferably an opposite groove. The rims and/or ridges fit with the grooves 5407 to improve the seal of the second seal 5406 and the stability of its position in the dispenser.

The blocking of the passage in embodiments similar to 2000, 3000 and 4000 may be carried out with seal having a circumference with grooves, like in embodiment 5000. Likewise, embodiments similar to 2000, 3000 and 4000 may be equipped with a rod having a head.

The examples described above present various selected embodiments of a refillable cream dispenser. It is noted that further embodiments are anticipated which also fall within the scope of the present invention. The scope of the present invention is defined by the claims and includes both combinations and sub combinations of the various features described hereinabove as well as variations and modifications thereof, which would occur to persons skilled in the art upon reading the foregoing description.

The invention claimed is:

1. A refillable spray dispenser comprises:

a bottle having a spray assembly and a compartment in fluid communication with the spray assembly;

the bottle further having a bottom portion comprising:

a hollow injection rod comprising a rod fill hole, a rod injection hole, and a groove along the hollow injection rod;

bottom portion walls;

a first seal and a second seal;

a bottom opening;

a portion injection hole and a portion exhaust hole provided in the bottom portion walls; and a passage extending from the portion exhaust hole to the bottom opening, wherein, when the hollow injection rod is at a resting position, the first seal seals the passage, preventing communication of gas from the compartment to the bottom opening, and the second seal seals the rod injection hole, preventing communication of liquid from the rod fill hole to the compartment, wherein, when the hollow injection rod is in an extended position and the dispenser is being refilled, the first seal allows communication of gas from the compartment, via the portion exhaust hole and the passage to the bottom opening, and the second seal allows communication of liquid from the rod fill hole, via the rod injection hole, to the compartment, and wherein said groove allows gas to bypass said first seal since the first seal grips the entire circumference of the hollow injection rod and cannot seal the groove in the extended position.

2. The refillable spray dispenser of claim 1, wherein the bottom portion further comprises a third seal situated between the portion exhaust hole and the second seal, and wherein the third seal tightly holds the hollow infection rod such as to help prevent back-flow of liquid out of the bottom portion when the hollow injection rod is in the extended position and the dispenser is being refilled.

3. The refillable spray dispenser of claim 1, wherein the portion exhaust hole is positioned between the first seal and the second seal.

4. The refillable spray dispenser of claim 1, wherein the portion exhaust hole and the second seal are positioned at a same level, and wherein the passage comprises a gap between said second seal and said bottom portion walls so as to allow gas from the compartment to bypass the second seal and thereby flow from the exhaust hole to the bottom hole when the rod is in the extended position.

5. The refillable spray dispenser of claim 1, wherein the hollow injection rod further comprises a tooth proximal to the bottom opening, and the dispenser further comprising resilient elements held on the tooth, wherein the resilient elements are configured to restore the hollow injection rod from the extended position back to the resting position.

6. The refillable spray dispenser of claim 1, further comprising an endcap engaged with the bottom portion walls, the endcap being capable of supporting the hollow injection rod.

7. The refillable spray dispenser of claim 1, further comprising a third seal held in the bottom portion under the hollow injection rod, wherein the third seal allowing to sealingly and fluidly couple a filling stem of a fluid bottle or a fluid-stem adaptor thereto.

8. The refillable spray dispenser of claim 1, wherein the first seal has a circumference comprising grooves.

9. The refillable spray dispenser of claim 1, further comprising a tube extending from the compartment adjacent the top opening to adjacent the portion exhaust hole, the tube thereby allowing exhaust of gas from the dispenser and essentially preventing exhaust of liquid from the dispenser.

10. The refillable spray dispenser of claim 1, further comprising a gas-permeable gasket configured to be in fluid communication with the portion exhaust hole when the hollow injection rod is in the extended position, allowing slow and controlled release of gas from the dispenser.

11. The refillable spray dispenser of claim 1, wherein the bottle has rigid walls configured to allow forming a negative air pressure in the compartment, wherein the negative pressure thereby facilitates filling of the compartment with fluid.

12. The refillable spray dispenser of claim 11, wherein there is essentially no take up of air in the compartment in compensation for the liquid being dispensed.

13. The refillable spray dispenser of claim 1, wherein the spray assembly comprises a vent hole that is arranged to compensate for dispensed liquid with air.

14. The refillable spray dispenser according to claim 13, wherein the spray assembly is mounted on top opening in a storage position in which the vent hole is closed off, wherein said spray assembly is movable with respect to the compartment in a dispensing position which said vent hole is free to enable air to be taken up.

15. The refillable spray dispenser of claim 1, wherein the spray assembly comprises a dispensing pump actuatable by means of a push button, wherein the push button is mounted on a nozzle of the pump, wherein the push button comprises an upper region enabling exertion of finger pressure on said push button to be able to move said button axially, thereby actuating the pump, wherein the pump comprises:

a body equipped with a plunger tube disposed in the bottle, wherein said tube is equipped with a valve for admitting the liquid into the pump;

a piston mounted around said nozzle to delimit a metering chamber in the body;

an extender within the body; and a spring in abutment with a bottom of the extender, wherein return of the push button over its suction travel is effected by a spring in said pump.

16. The dispenser of claim 1, wherein the sealing of the rod injection hole is due to the hollow injection rod fitting tightly within the second seal.

17. A kit comprising the refillable spray dispenser of claim 1 and at least one adaptor, wherein the adaptor is configured to allow sealingly and fluidly coupling a non-refillable dispenser with the hollow injection rod of the refillable dispenser.

18. The kit of claim 17, wherein the non-refillable dispenser is a liquid dispenser or an aerosol.

19. A kit comprising the refillable dispenser of claim 1 and a non-refillable dispenser, the refillable dispenser and the non-refillable dispenser sealingly and fluidly coupleable thereto.

* * * * *